US010111499B2

(12) United States Patent
Fiedler et al.

(10) Patent No.: US 10,111,499 B2
(45) Date of Patent: Oct. 30, 2018

(54) BUCKLE ASSEMBLY FOR A BELT STRAP

(71) Applicant: Fidlock GmbH, Hannover (DE)

(72) Inventors: Joachim Fiedler, Hannover (DE); Breido Botkus, Hannover (DE); Friedemann Richter, Hannover (DE)

(73) Assignee: Fidlock GmbH, Hannover (DE)

( * ) Notice: Subject to any disclaimer, the term of this patent is extended or adjusted under 35 U.S.C. 154(b) by 155 days.

(21) Appl. No.: 15/013,226

(22) Filed: Feb. 2, 2016

(65) Prior Publication Data

US 2016/0219986 A1 Aug. 4, 2016

(30) Foreign Application Priority Data

Feb. 4, 2015 (DE) ..... 10 2015 201 947

(51) Int. Cl.

| | |
|---|---|
| ***A44B 11/10*** | (2006.01) |
| ***A44B 11/00*** | (2006.01) |
| ***A44B 11/18*** | (2006.01) |
| ***A42B 3/08*** | (2006.01) |

(52) U.S. Cl.

CPC ..... *A44B 11/10* (2013.01); *A42B 3/08* (2013.01); *A44B 11/008* (2013.01); *A44B 11/18* (2013.01)

(58) Field of Classification Search

CPC ..... A44B 11/10; A44B 11/18; A44B 11/008; A42B 3/08; Y10T 24/4014; Y10T 24/4084; Y10T 24/4086

See application file for complete search history.

(56) References Cited

U.S. PATENT DOCUMENTS

| | | | | | |
|---|---|---|---|---|---|
| 699,502 | A * | 5/1902 | Durland | A44B 11/10 | 139/88 |
| 963,201 | A * | 7/1910 | Arnold | A44B 11/10 | 24/171 |
| 3,162,915 | A | 12/1964 | Rosenberg | | |
| 3,404,436 | A * | 10/1968 | McMurray | A44B 11/10 | 24/168 |
| 3,893,210 | A * | 7/1975 | Hildebrandt | A44B 11/125 | 24/171 |
| 4,608,735 | A * | 9/1986 | Kasai | A44B 11/10 | 24/171 |

(Continued)

FOREIGN PATENT DOCUMENTS

| | | |
|---|---|---|
| AU | 2002315649 B2 | 10/2002 |
| DE | 252886 | 10/1912 |

(Continued)

*Primary Examiner* — Robert Sandy
*Assistant Examiner* — Matthew J Sullivan
(74) *Attorney, Agent, or Firm* — The Webb Law Firm

(57) ABSTRACT

A buckle assembly for a belt webbing includes a buckle body which includes at least one abutment portion and is connectable with at least one belt webbing. In a connected condition at least one first abutment part of the at least one belt webbing rests against the at least one abutment portion. The buckle assembly furthermore includes a clamping loop arranged on the buckle body, which is circumferentially closed and defines an opening. The clamping loop is arranged on the abutment portion around the buckle body such that the buckle body extends through the opening and is formed to act on the abutment part, which in the connected condition rests against the abutment portion, with a force in a direction of the at least one abutment portion.

9 Claims, 1 Drawing Sheet

(56) References Cited

U.S. PATENT DOCUMENTS

| | | | | |
|---|---|---|---|---|
| 8,695,176 | B2 | 4/2014 | Gangakhedkar et al. | |
| 2013/0029813 | A1 | 1/2013 | Hetrick et al. | |
| 2013/0305493 | A1 | 11/2013 | Hortnagl | |
| 2017/0066578 | A1* | 3/2017 | Kierstead | B65D 63/14 |
| 2017/0127764 | A1* | 5/2017 | Fiedler | A44B 11/12 |

FOREIGN PATENT DOCUMENTS

| | | | | |
|---|---|---|---|---|
| DE | 1173713 | B | 7/1964 | |
| DE | 10119469 | A1 | 11/2002 | |
| FR | 2143619 | A1 * | 2/1973 | A44B 11/10 |
| WO | 2012109682 | A1 | 8/2012 | |
| WO | 2013019610 | A2 | 2/2013 | |

* cited by examiner

BUCKLE ASSEMBLY FOR A BELT STRAP

CROSS-REFERENCE TO RELATED APPLICATION

This application claims priority to German Patent Application No. 102015201947.0 filed Feb. 4, 2015, the disclosure of which is hereby incorporated in its entirety by reference.

BACKGROUND OF THE INVENTION

Field of the Invention

This invention relates to a buckle assembly for a belt webbing.

Description of Related Art

Such buckle assembly for a belt webbing for example can be a buckle assembly for the chin straps of a ski helmet or a bicycle helmet. However, the buckle assembly also can be for example a buckle assembly for the shoulder straps of a backpack or for the straps of a life vest.

Such buckle assembly for a belt webbing comprises a buckle body which includes at least one abutment portion and is connectable with at least one belt webbing, wherein in a connected condition at least one first abutment part of the at least one belt webbing rests against the at least one abutment portion.

Buckle assemblies as mentioned above are known in various embodiments and can comprise for example double-D ring buckles, double-stay buckles, triple-stay buckles, ladder-stay buckles, sliding buckles, or clamping buckles.

Such buckle assemblies frequently serve for a length-adjustable fixation of a belt webbing assembly. The fixation of the belt webbing assembly generally is based on a force-fit connection between at least one belt webbing part and a portion of the buckle body and/or between various belt webbing parts in the region of the buckle body.

The clamping action underlying the force-fit connection in many buckle assemblies is particularly effective when a directed tensile force acts on at least one belt webbing end. Correspondingly, the problem frequently exists that in an unloaded belt webbing assembly, i.e. in the absence of directed tensile forces on at least one belt webbing end the length fixation of a belt webbing assembly by the buckle assembly is ensured only unreliably. For example, the chin straps of a bicycle helmet, which initially are not tightened quite firmly by means of a buckle assembly, can loosen in the course of time. This undesired effect even is intensified by the movement of the chin, i.e. by irregular tensile forces on the straps.

In a buckle assembly known from WO 2013/019610 A2 a loop is arranged on a belt webbing, in order to prevent inadvertent shifting of the belt webbing. The loop is provided separate from a buckle body, which can lead to the fact that the—wanted—shifting of the belt webbing is impeded and thus becomes more awkward for a user.

SUMMARY OF THE INVENTION

It is an object of the present invention to provide a buckle assembly for a belt webbing, which ensures a reliable length-adjustable fixation of a belt webbing assembly in a simple and inexpensive way.

Accordingly, the buckle assembly furthermore comprises a clamping loop arranged on the buckle body, which is circumferentially closed and defines an opening. The clamping loop is arranged on the abutment portion around the buckle body such that the buckle body extends through the opening. The clamping loop also is formed to act upon the abutment part, which in the connected condition rests against the abutment portion, with a force in direction of the at least one abutment portion.

In the connected condition of the buckle body and the at least one belt webbing the clamping loop provides an additional force-fit connection between an abutment part of a belt webbing and an abutment portion of the buckle body, which is independent of directed tensile forces on a belt webbing end. In this way, the undesired loosening of the length fixation of an unloaded or temporarily unloaded belt webbing assembly can be avoided wholly or in part.

The clamping loop in particular can have the shape of a circumferentially closed ring, for example in the form of a so-called O-ring. The clamping loop preferably is flexibly deformable in itself and furthermore advantageously is lengthways elastic, i.e. extensible along its circumferential direction.

In an advantageous aspect of the invention the clamping loop can be formed elastic. In particular, the clamping loop can elastically be pretensioned in the connected condition of the buckle body and the at least one belt webbing. The force in direction of the at least one abutment portion then is effected by the elastic pretension of the clamping loop wholly or in part.

In one development of the buckle assembly the buckle body includes at least one holding device which is formed to prevent that the clamping loop slides down from the buckle body along a main loading direction in which a loading force acts on the at least one belt webbing. Thus, the clamping loop in a simple way can be held at the buckle body in the region of the abutment portion.

In one variant, the holding device comprises at least one protrusion protruding from the buckle body, which supports the clamping loop in the main loading direction. Sliding down of the clamping loop from the buckle body along the main loading direction in this way can be prevented by the protrusion.

In one embodiment, the clamping loop is cohesively connected with the buckle body. For example, a portion of the clamping loop can be glued or welded to a portion of the buckle body. A possible loss of the clamping loop thus is prevented.

In another embodiment, the clamping loop is integrally formed with the buckle body. In this way, a loss of the clamping loop likewise can be avoided, wherein the manufacturing costs of such integrally formed assembly of buckle body and clamping loop can be particularly favorable as a result of few mounting steps.

In one variant of the buckle assembly according to the invention, at least one second abutment part of the at least one belt webbing or another belt webbing rests against the at least one first abutment part in the connected condition, wherein the clamping loop acts on the at least one second abutment part with the force in direction of the at least one abutment portion. Thus, a force-fit connection can be created not only between the abutment portion of the buckle body and the first abutment part of the belt webbing, but also between the first abutment part and the second abutment part. Correspondingly, a particularly strong force-fit connection can be produced, which effectively prevents undesired loosening of the length fixation of the belt webbing assembly.

In this case, the belt webbing for example is wound around a stay of the buckle body, so that the first abutment part and the second abutment part of the belt webbing come to lie in the region of the abutment portion of the buckle body and are acted upon with a force by the clamping loop, in order to increase a friction of the abutment parts with the abutment portion and in this way prevent or at least complicate shifting of the abutment parts relative to each other—in particular also in a condition in which no or only small tensile forces act on the belt webbing.

In an advantageous embodiment, the buckle assembly comprises at least one double-D ring buckle, double-stay buckle, triple-stay buckle, ladder buckle, sliding buckle or clamping buckle. In such buckles, the above-described problem of the undesired loosening of the length fixation of a belt webbing in the unloaded condition frequently occurs, so that the buckle assembly according to the invention here can be used in a particularly advantageous way.

The belt webbing preferably is formed non-elastic along its direction of longitudinal extension. The belt webbing for example can be fabricated from a woven fabric or also from leather or the like.

A buckle assembly as described here advantageously can be used in backpacks, bags, suitcases or other types of container. A buckle assembly as described here also can be used on helmets, in particular ski, bicycle or motorcycle helmets or wherever shifting of a belt webbing relative to the buckle body should be prevented.

BRIEF DESCRIPTION OF THE DRAWINGS

The idea underlying the invention will be explained in detail below with reference to the exemplary embodiments illustrated in the Figures, in which.

DETAILED DESCRIPTION OF THE INVENTION

Figure 1A:
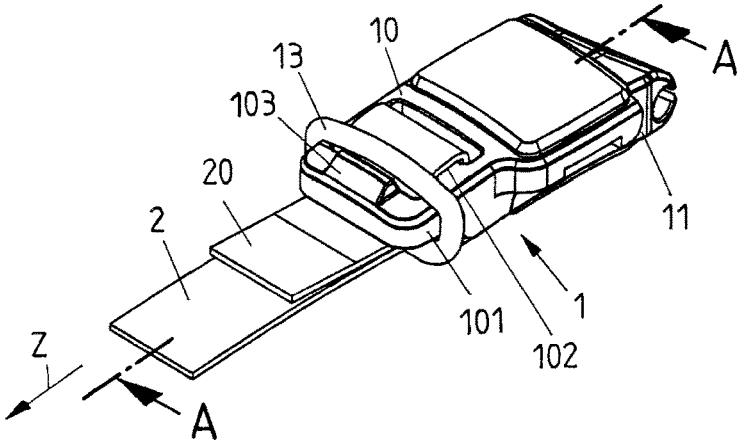
FIG. 1A shows a buckle assembly for a belt webbing with a clamping loop arranged on a buckle body.
Figure 1B:
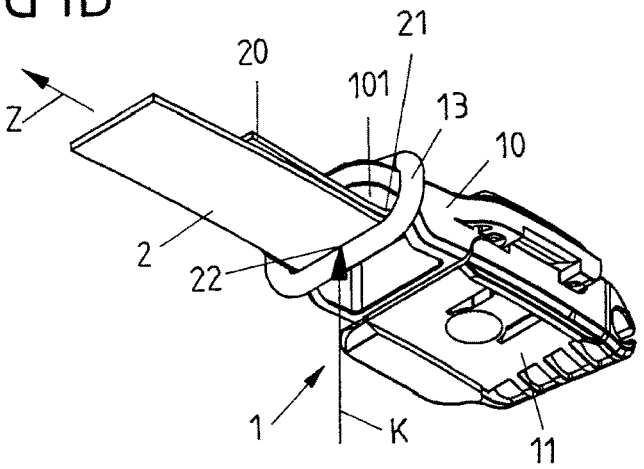
FIG. 1B shows a view from below of the buckle assembly of FIG. 1A.

FIGS. 1A and 1B show a buckle assembly 1 for a belt webbing from different perspectives, as it can be used in various ways for example on a garment, a helmet or a bag. The buckle assembly 1 comprises a buckle body 10 which is formed to be brought into a releasable latching connection with a second buckle body 11.

The buckle body 10 is connected with a belt webbing 2. As it is known from triglides, a belt webbing end 20 of the belt webbing 2 is wound around a stay 102 of the buckle body 10 and is again guided out of the buckle body 10 along a direction Z of the belt webbing. The buckle body 10 includes an abutment portion 101, against which a first abutment part 21 of the belt webbing 2 rests in the illustrated connected condition.

Figure 1C:
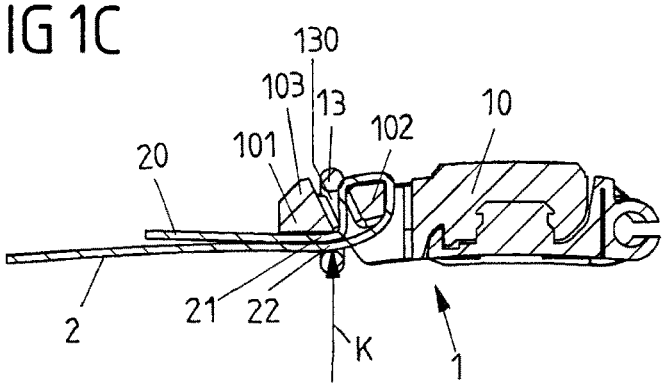
FIG. 1C shows a longitudinal section along line A-A through the buckle assembly shown in FIG. 1A.

In an unloaded condition 2, i.e. when no tensile force Z acts on the belt webbing 2, the length of a belt webbing assembly, which comprises the belt webbing 2, can be shifted by pushing the belt webbing 2 and pulling the belt webbing end 20. In a loaded condition of the belt webbing assembly, in which a tensile force Z acts on the belt webbing 2, adjacent first and second abutment parts 21, 22 of the belt webbing 2 are locked against each other and the abutment portion 101 of the buckle body 10 such that shifting against each other and thus a longitudinal adjustment of the belt webbing assembly is prevented, as can be seen in the sectional representation of FIG. 1C.

In other exemplary embodiments, the belt webbing end 20 also can be guided around more than one stay 102 in the manner of a double-stay, triple-stay or ladder buckle, in order to increase the acting frictional forces and reinforce the force-fit connection.

To counteract undesired longitudinal shifting of the belt webbing assembly in the unloaded condition, a clamping loop 13 is arranged on the buckle body 10. The clamping loop 13 is circumferentially closed and defines an opening 130. For example, the clamping loop 13 can be a circumferentially closed flexible ring in the manner of an O-ring.

In the illustrated connected condition the buckle body 10 extends through the opening 130, so that the clamping loop 13 fully encloses the abutment portion 101 of the buckle body 10.

The belt webbing 2, with which the buckle body 10 is connected, likewise extends through the clamping loop 13, so that the clamping loop 13 in particular also fully encloses the first and second abutment parts 21, 22 of the belt webbing 2.

The clamping loop 13 acts upon the abutment part 21 of the belt webbing 2 with a force K in direction of the abutment portion 101. At the same time, the clamping loop 13 acts upon the second abutment part 22 of the belt webbing, which rests against the first abutment part 21, with a force K in direction of the abutment portion 101 and in direction of the first abutment part 21.

Preferably, the clamping loop 13 is formed elastic for this purpose. For example, the clamping loop 13 can be fabricated of a lengthways elastic material such as silicone or a thermoplastic elastomer.

In particular, in the illustrated connected condition of the buckle body 10 and the at least one belt webbing 2 such elastic clamping loop 13 can be pretensioned elastically. An elastic pretension of the clamping loop 13 for example can be produced already in that the buckle body 10 extends through the opening 130 of the clamping loop 13. The force K for example can wholly or partly be effected by the elastic pretension of the clamping loop 13.

By the force K, the first abutment part 21 and the second abutment part 22 of the belt webbing 2 are fixed at each other and/or at the abutment portion 101 of the buckle body 10 in a force-fit manner such that also in the unloaded condition of the belt webbing assembly, i.e. when no tensile force Z (or only a small tensile force Z) acts on the belt webbing 2, an undesired length adjustment of the belt webbing assembly is avoided wholly or in part.

As can be seen with reference to FIG. 1A, the buckle body 10 includes a protrusion as holding device 103, which prevents that the clamping loop 13 slides down from the buckle body 10 along a main loading direction Z, in which the tensile force Z as loading force acts on the at least one belt webbing 2. The protrusion supports the clamping loop 13 in the main loading direction Z. Sliding down of the clamping loop 13 from the buckle body 10 along the main loading direction Z in this way can be prevented by the protrusion 103.

It is also conceivable, however, that the holding device 103 is not formed as protrusion, but in some other way, for example as recess or groove. With such holding device 103, the clamping loop 13 can easily be held at the buckle body 10 in the region of the abutment portion 101.

To ensure the proper arrangement of the clamping loop 13 at the buckle body 10 at any time and to prevent a loss of the clamping loop 13 in a demounted condition of the buckle assembly 1, it can be advantageous to cohesively connect the clamping loop 13 with the buckle body 10. For example, the clamping loop 13 can be glued or welded to a lateral portion of the buckle body 10.

In one variant, the clamping loop 13 can however also be formed integrally with the buckle body 10. This can involve the advantage of a particularly easy and inexpensive assembly of the buckle assembly 1.

LIST OF REFERENCE NUMERALS

1 buckle assembly
10 buckle body
11 second buckle body
101 contact portion
102 stay
103 holding device
13 clamping loop
130 opening
2 belt webbing
20 belt webbing end
21 first abutment part
22 second abutment part
K force
Z tensile force

The invention claimed is:

1. A buckle assembly for a belt webbing, comprising:

a buckle body including at least one abutment portion and at least one stay, the buckle body being connectable with at least one belt webbing, wherein in a connected condition at least one first abutment part of the at least one belt webbing extends about the at least one stay and rests against the at least one abutment portion, a clamping loop arranged on the buckle body, which is circumferentially closed along a circumferential direction and defines an opening, the clamping loop being formed elastic such that the clamping loop is elastically extensible along the circumferential direction, wherein the clamping loop is arranged on the abutment portion around the buckle body such that the buckle body extends through the opening, and is formed to act upon the at least one first abutment part with a tensioning force pointing towards the at least one abutment portion, the tensioning force being directed transverse to a main loading direction which a loading force acts on the at least one belt webbing in a loaded condition of the buckle assembly.

2. The buckle assembly according to claim 1, wherein the clamping loop is elastically pretensioned in the connected condition of the buckle body and the at least one belt webbing.

3. The buckle assembly according to claim 1, wherein the buckle body comprises at least one holding device which is formed to prevent the clamping loop from sliding down from the buckle body along said main loading direction.

4. The buckle assembly according to claim 3, wherein the holding device comprises at least one protrusion protruding from the buckle body, which supports the clamping loop in the main loading direction.

5. The buckle assembly according to claim 1, wherein the clamping loop is cohesively connected with the buckle body.

6. The buckle assembly according to claim 1, wherein the clamping loop is formed integrally with the buckle body.

7. The buckle assembly according to claim 1, wherein in the connected condition at least one second abutment part of the at least one belt webbing or another belt webbing rests against the at least one first abutment part, wherein the clamping loop acts on the at least one second abutment part with said tensioning force pointing towards the at least one abutment portion.

8. The buckle assembly according to claim 1, wherein the at least one abutment portion is formed as stay and extends parallel to the at least one stay, wherein in the connected condition the at least one belt webbing extends between the at least one abutment portion and the at least one stay and wherein the at least one first abutment part rests against the at least one abutment portion.

9. The buckle assembly according to claim 1, wherein the buckle assembly comprises at least one double-D ring buckle, double-stay buckle, triple-stay buckle, ladder buckle, sliding buckle, or clamping buckle.

* * * * *